United States Patent [19]

McCain et al.

[11] 4,384,709

[45] May 24, 1983

[54] SIGNATURE GATHERING MACHINE

[75] Inventors: William B. McCain, Hinsdale; James F. Cosgrove, Western Springs, both of Ill.; George D. Higgins, Kansas City, Mo.

[73] Assignee: McCain Manufacturing Company, Chicago, Ill.

[21] Appl. No.: 277,995

[22] Filed: Jun. 26, 1981

[51] Int. Cl.[3] ..... B65H 39/02

[52] U.S. Cl. ..... 270/54; 198/644

[58] Field of Search ..... 198/644; 270/54

[56] References Cited

U.S. PATENT DOCUMENTS 2,711,897 6/1955 Grunlee ..... 270/54 X 3,317,026 5/1967 Zugel ..... 198/644 X

*Primary Examiner*—A. J. Heinz

*Attorney, Agent, or Firm*—Kinzer, Plyer, Dorn & McEachran

[57] ABSTRACT

This invention is concerned with the elimination of vibration in signature gathering machine delivery chains. Reciprocal motion in some components of a signature gathering system creates periodic forces which may be at or near the natural frequency of the delivery chain. This causes undesired vibration in the chain. The present invention damps this vibration by continuously constraining the lower run of the chain and by placing a positive drive at the tail end sprocket of the chain to take up some of the slack in the return run. The vibration is also substantially reduced at its source by placing a flywheel on the mainline drive shaft near the point where the reciprocal motion is derived.

2 Claims, 6 Drawing Figures

SIGNATURE GATHERING MACHINE

BACKGROUND OF THE INVENTION

This invention relates to signature gathering machines. Signatures, which are folded sheets, are stored in a plurality of pockets. The signatures are gathered by pocket feeders which place them one on top of another on a delivery chain or conveyor. The collected signatures are known as a book. In the type of binding known as saddle binding, the signatures are gathered on a saddle, with the two legs of the signature astride the saddle. After all the signatures are collected, the book is advanced stepwise along the saddle to a stitching station where the book is stitched along the backbone, usually by staples. Stepwise movement of the book to the stitching station is accomplished by grippers on a gripper bar as will be explained in more detail below. The gripper bar is reciprocated along a horizontal path.

After the book is stitched it is advanced to a delivery station where there is a pair of rollers for delivering the completed book to yet another station, usually a trimming station where the head and foot of the book are trimmed. The book is lifted upward off the saddle and introduced into the bight of the delivery rollers by a so-called tucker blade.

Signature gathering machines of the type described have been subject to vibration problems in the delivery chain or conveyor. Vibration of the delivery chain tends to joggle the signatures as they are carried along on the conveyor. This causes the margins of the signatures to become uneven with the result that the books cannot be cleanly trimmed.

SUMMARY OF THE INVENTION

This invention relates to an improved signature gathering machine. It is an object of the invention to substantially eliminate vibration in the delivery conveyor by preventing the periodic application of force to the chain at or near its natural frequency. In this connection, the present invention involved identifying the source of periodic applications of force and eliminating the tendency of this force to create vibration in the chain.

Another object is to control the effects of chain vibration by damping the vibration through means of a continuous chain constraint or guide.

Another object is to eliminate the effects of chain vibration by positively driving the tail end sprocket on the return run of the conveyor.

Other objects will appear in the following specification, drawings and claims.

DESCRIPTION OF A PREFERRED EMBODIMENT

Figure 1:
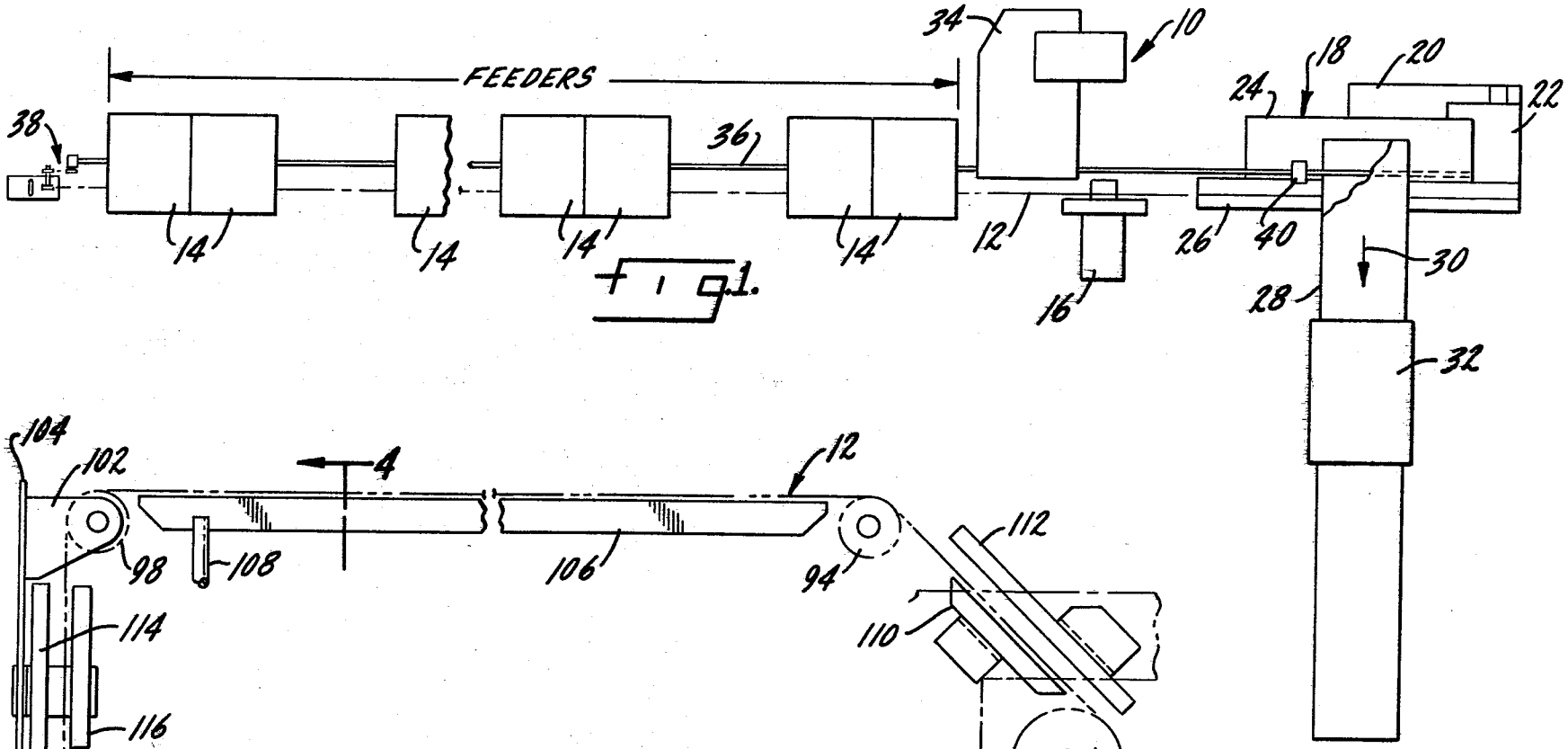
FIG. 1 is a schematic, plan view of a signature gathering machine layout.

A complete layout of a signature gathering machine 10 is shown in FIG. 1. The machine includes a delivery chain or conveyor 12 which is commonly in the form of a saddle-type conveyor. The individual signatures are fed onto the saddle conveyor in straddling relation thereto by a plurality of pocket feeders 14. After the signatures are gathered to constitute the pages of a complete book, the books are advanced past a caliper 16 which measured the book thickness to ensure that none of the individual signatures comprising a book is missing.

After passing the caliper, the books are advanced one by one to a stitching station indicated generally at 18. This movement of the books to the stitching station is accomplished by horizontally reciprocal grippers. At the stitching station, the backbones of the signatures are joined by staples. The stitching machine includes a base 20, a gripper bar drive 22, a cam control portion 24 and a gripper bar slideway 26. Several of the details of the stitching machine will be described below. Further details can be found in U.S. Pat. Nos. 3,542,271 and 3,876,129.

The completed books are moved out of the stitching station by the same grippers that advanced the books from the conveyor chain. The books are advanced to a delivery station where there is a vertically movable tucker blade positioned beneath the saddle. The tucker is effective to lift each book off the saddle and present it to delivery means 28. The books move in a direction shown by the arrow 30 to a trimming machine 32. The trimming machine trims the head and food of each book so the edges of the book are even. Details of a trimming machine can be found in U.S. Pat. Nos. 3,732,766 and 3,981,212.

All of the components of the gathering machine 10 are driven from a main drive unit 34. Mechanical power is transferred to the various system components by a mainline drive shaft 36. At the left end of the mainline drive shaft is a tail end return-sprocket drive indicated generally at 38. This will be described in detail below. The right end of the mainline drive shaft is connected to the gripper bar drive unit 22 of the stitcher. Located between the main drive 34 and the gripper bar drive 22 is a flywheel 40. The purpose of the flywheel will be described below.

Figure 2:
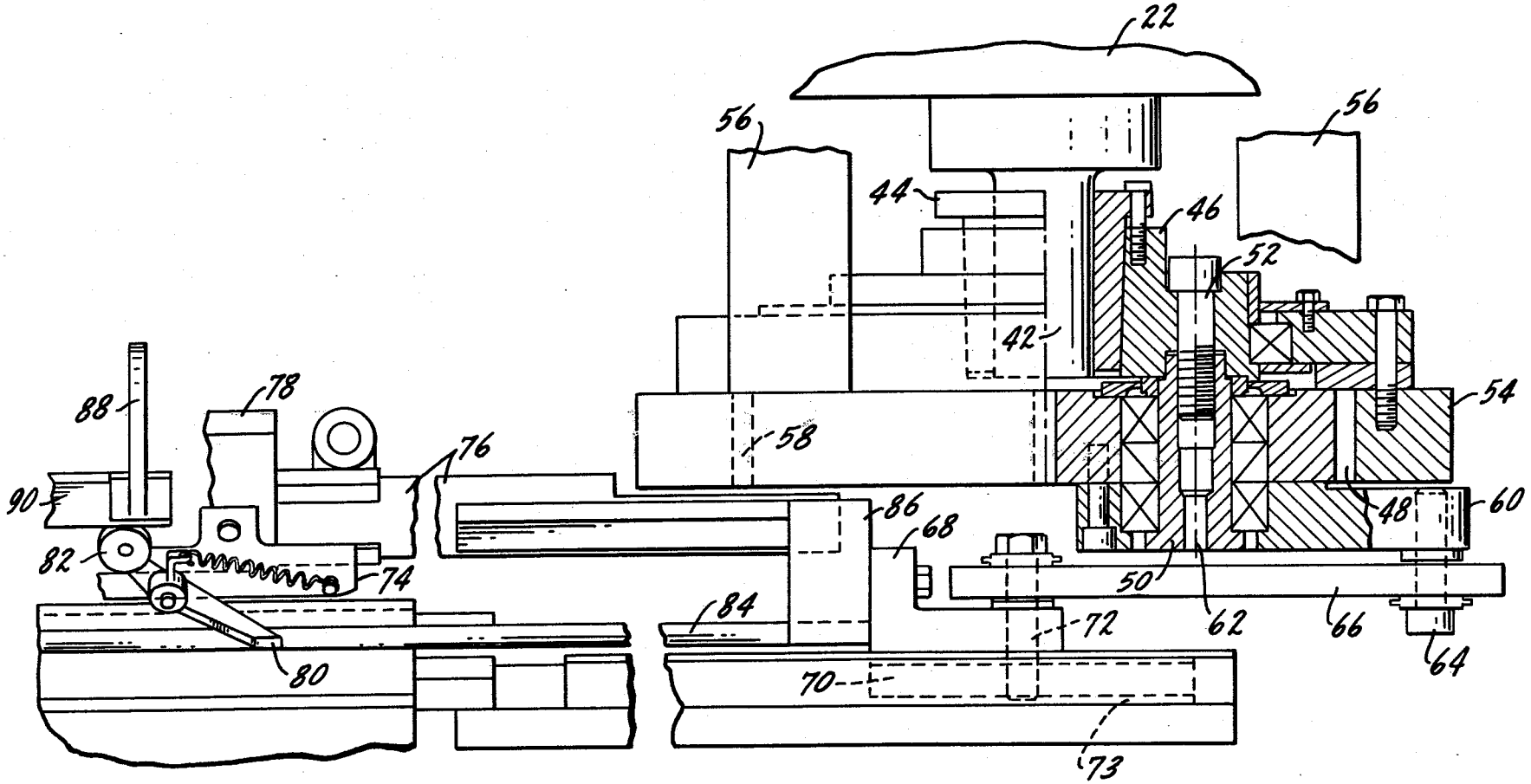
FIG. 2 is a plan view, partially in section, showing some details of the drive for the stitcher gripper bar.

Some of the details of the stitcher gripper bar drive mechanism are shown in FIG. 2. The gripper bar drive 22 is indicated diagrammatically. As mentioned above, it is driven by the mainline drive shaft and includes a speed reducer. The output of the speed reducer is the drive shaft 42. The drive shaft has a bushing 44 attached thereto. A drive hub 46 is bolted to the bushing 44. The hub and bushing rotate together on the drive shaft 42.

A pinion gear 48 is eccentrically mounted on the hub 46 by a pinion stud 50. The stud is secured by a long cap screw 52. An internal gear 54 is mounted on a pair of support bars 56. The internal gear has teeth 58 in mesh with the external teeth of the pinion 48.

A drive arm 60, at the front of the pinion gear 48, is pivotally supported thereon in the manner shown in FIG. 2. From this it will be seen that as the pinion gear 48 is driven about the internal track 58 by the hub 46, the drive arm 60 will be carried along with the pinion. As the pinion gear circumnavigates the internal gear, the pivotal axis 62 of the drive arm 60 will also travel in a circle. However, the end of the drive arm 60 is connected by a pin 64 to a connecting rod 66. The other end of the connecting rod is pinned to a slide block bracket 68 and a slide block 70, the connection being made by a slide block bolt 72. By virtue of this connection between the drive arm 60 and the slide block parts, the latter will be reciprocated along a substantially horizontal path defined by a track 73.

The gripper bar itself is shown at 74. It is attached to a gripper slide bar 76 which slides on a gripper bar track 78. The gripper bar includes a plurality of spring-biased, pivotally mounted gripper fingers 80. One end of the fingers carries a cam followed 82, while the other end bears against an under bar 84. Both the under bar 84 and the gripper slide bar 76 are connected by a link 86 to the slide block bracket 68.

When it is desired to open a gripper finger 80 to pick up a book, a gripper rocker arm 88 moves toward the gripper fingers, thereby presenting an opener cam 90 to the gripper cam follower 82. This causes the finger 80 to pivot about its mounting until the opener cam is removed, whereupon the spring biases the finger to the closed position. The book is then held between the finger and the under bar 84.

It will be understood that other types of drives for imparting linear motion to the gripper bar may be employed. For example, a simple crank and rocker arm arrangement can be used. But whatever the drive arrangement, the gripper bar will have a reciprocating, linear movement for stepwise advancement of books to the stitcher heads. It has been found in accordance with the present invention that the linear drive mechanism is the source of vibration in the delivery conveyor. The torque reversals in the linear drive generate periodic forces which, by virtue of the common mainline drive shaft, are transferred to the delivery conveyor. When these periodic applications of force are at or near the natural frequency of the delivery conveyor, vibration of the conveyor results. The present invention involves several measures which may be taken to either damp the vibration in the conveyor chain or to substantially eliminate the vibration at its source.

Figure 3:
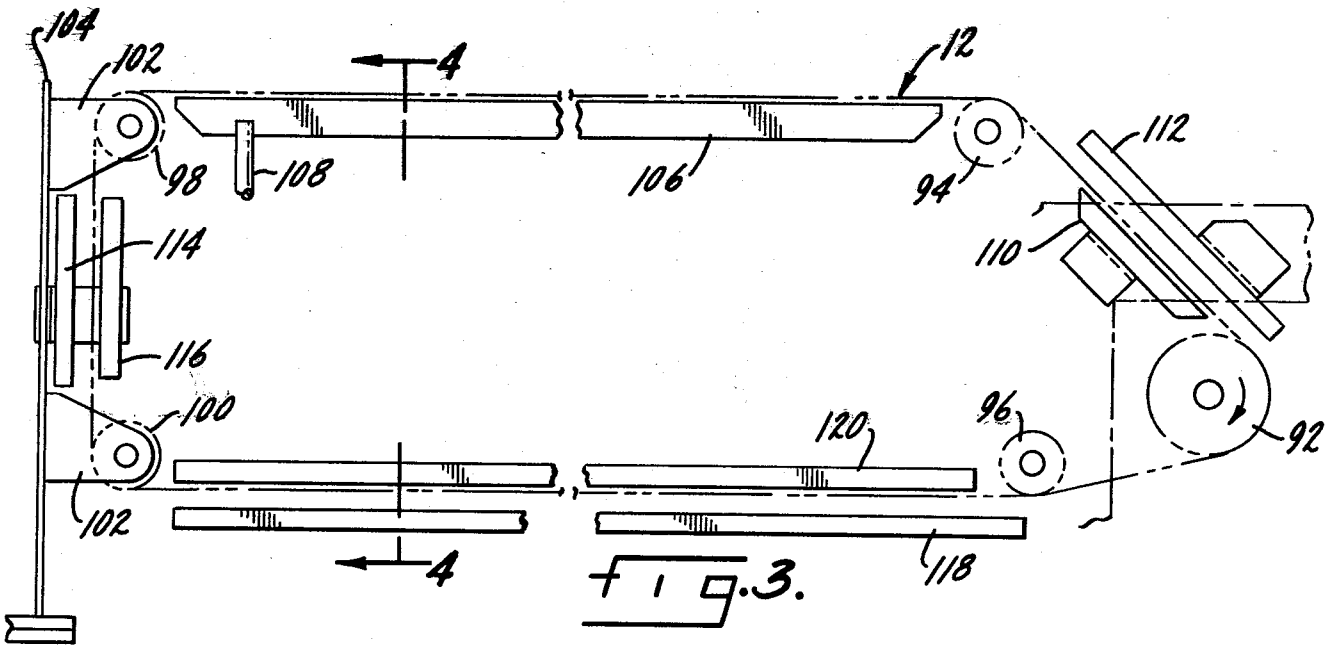
FIG. 3 is a schematic, elevation view of the delivery conveyor.
Figure 4:
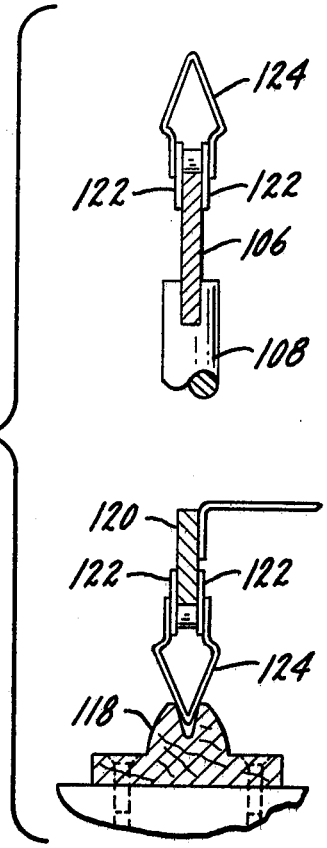
FIG. 4 is a view taken substantially along line 4—4 of FIG. 3.
Figure 5:
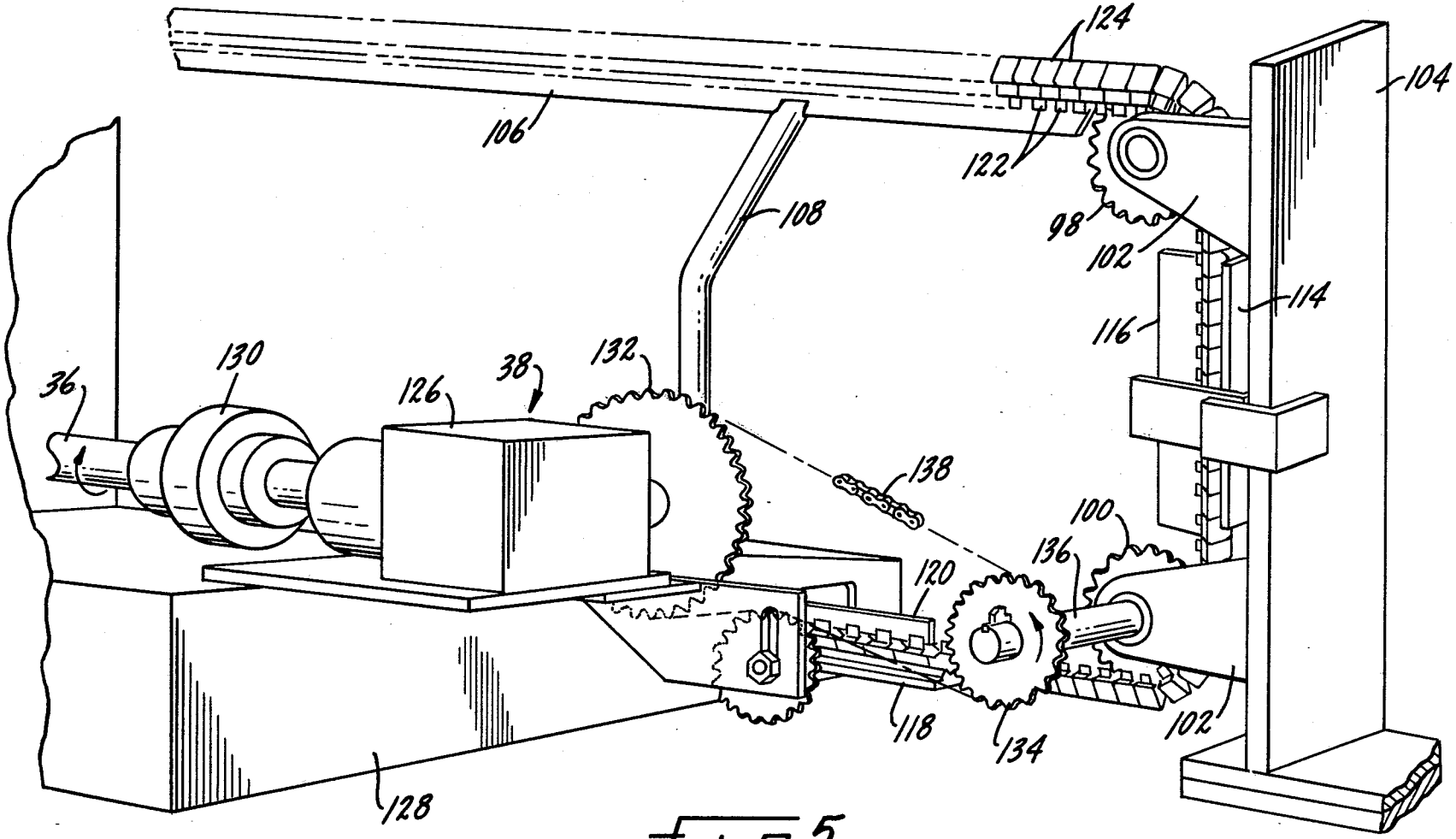
FIG. 5 is a perspective view of the tail end of the delivery conveyor.

FIGS. 3–5 illustrate one form of chain damping arrangement. The delivery conveyor 12 is driven by a main drive sprocket 92. The delivery conveyor revolves around upper and lower head end sprockets 94 and 96 and upper and lower tail end sprockets 98 and 100. The tail end sprockets are shown mounted on brackets 102 which are in turn connected to an adjustable post 104. The post permits adjustment of the tension in the delivery conveyor 12.

The forward run of the delivery conveyor is supported by an upper rail 106. The rail 106 is supported by a series of support arms, one of which is shown at 108. At the head end of the conveyor the delivery chain is supported by a head end rail 110 on its underside and on the upper side by a head end saddle track 112. These may be mounted on suitable brackets as shown. Similarly, at the tail end of the conveyor a tail end saddle track 114 and a tail end guide rail 116 are provided. On the return run of the conveyor a return saddle track 118 supports the under side of the conveyor. On the upper side a return guide rail 120 extends for substantially the entire length between the lower head sprocket 96 and the lower tail sprocket 100.

Details of the chain supports are shown in FIG. 4. The links of the delivery chain itself are shown at 122. The links 122 carry a plurality of saddle members 124 on which the signatures are placed. On the upper or forward run of the conveyor the upper guide rail 106 extends between the depending portions of the links 122 to support the chain. This is well known structure in signature machines. On the return run, the return saddle track 118, typically made of wood, is also a known conveyor guidance feature. Furthermore, in the past some very short chain guides have been used on lower run of the chain. These short, intermittent guides had a structure similar to the return guide rail 120, in that both types of guides extend between the protruding portions of the chain links, as shown in FIG. 4. But the previous guides were only for the purpose of making sure the chain did not become tangled or kinked when passing from one pocket feeder to the next. The previous guides, though utilizing a similar physical means as the present continuous rail 120, had nothing to do with the dynamics of the gathering machine. The difference is the previous guides were short, intermittent and incapable of damping chain vibration. The present invention utilizes a continuous rail along virtually the entire return run of the delivery conveyor.

The effect of the return guide rail 120 is to constrain the lower run of the chain so that it cannot vibrate either laterally or vertically. This reduces the tendency for the return run to produce longitudinal vibration in the forward run of the chain. The lower run of the chain can only vibrate by taking up some of the slack in the forward run of the chain. When that slack is taken up the result is longitudinal vibration in the forward run. There is a lot of play in a long chain drive due to the necessary looseness in the pins and links. Therefore, by constraining the lower run continuously, vibration is reduced in the lower run and, consequently, vibration is also reduced in the upper run. In other words, the chain is damped to prevent the unwanted vibration in the upper run of the conveyor. The guide rails 110 and 116 also provide constraint on the chain, further reducing the tendency of lower run vibration to cause vibration in the upper run.

Along these same lines, another way to substantially prevent objectionable vibration in the return run of the conveyor from affecting the forward run is to place a positive drive at the lower tail sprocket instead of just having an idler sprocket at that location. This is shown in FIG. 5. The tail sprocket drive is shown generally at 38. It includes a gear box 126 mounted on the signature machine base 128 and connected by a coupling 130 to the mainline drive shaft 36. The output shaft of the gear box 126 has a sprocket 132 mounted thereon. A drive sprocket 134 is keyed to a common shaft 136 on which the lower tail sprocket 100 is mounted. A chain 138 drives sprocket 134 from the sprocket 132.

In some machines the continuous constraint on the return run of the delivery conveyor may be sufficient to overcome the vibration problems. Or it may be necessary to combine the restraint with a positive drive at the lower tail sprocket. However, there may be instances where this attempt to damp the vibration in the chain will not sufficiently reduce the vibration. It then becomes necessary to eliminate the vibration at its source. As mentioned above, it has been found that the source of vibration in the delivery conveyor is the oscillatory, linear motion at the stitching machine together with its related drive. Having determined this to be the source of the vibration, it has been found that the vibration can be substantially eliminated by placing a flywheel on the mainline drive shaft near the takeoff point for the reciprocating drive mechanism.

Figure 6:
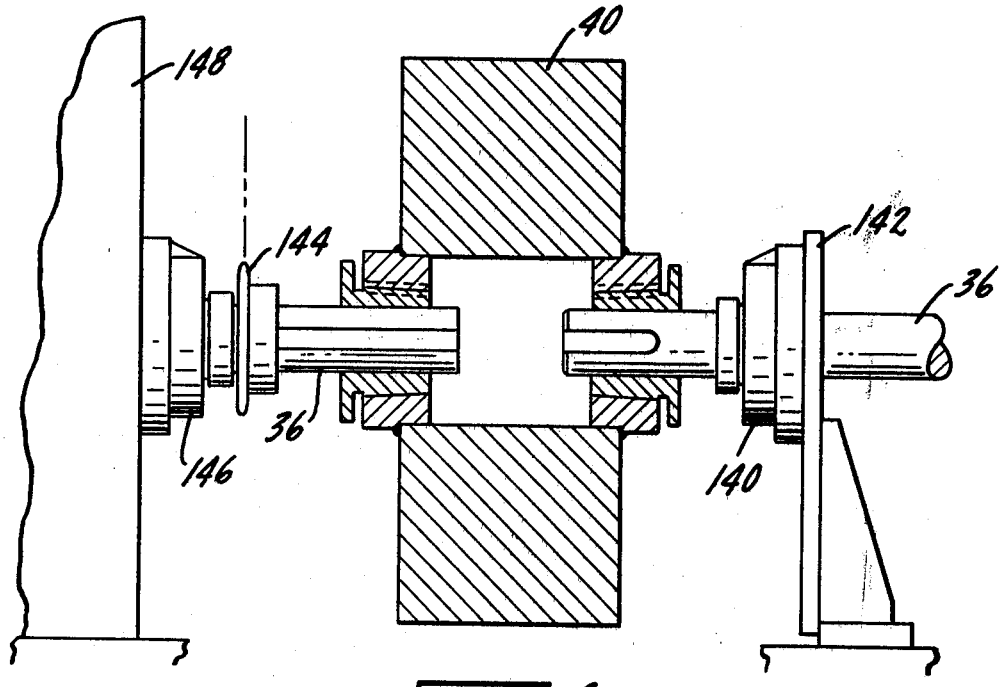
FIG. 6 is an elevation view, partially in section, of a portion of the mainline drive shaft with a flywheel attached thereto.

FIG. 6 shows the mounting of a flywheel 40 on the mainline drive shaft 36. As can be seen in FIG. 6 the flywheel also serves to couple two portions of the mainline drive shaft. The right-hand portion of the shaft extends to the the gripper bar drive 22. It is supported in a bearing 140 which is attached to a bearing bracket plate 142. The lefthand portion of the drive shaft has a first takeoff means engaging the shaft for driving the stitcher heads. The takeoff means is in the form of a sprocket 144. This portion of the shaft is supported in a bearing 146 which is attached to an upright section 148 of the stitcher frame. A flywheel weighing about 340 lbs. has been found effective to substantially reduce vibration in the delivery conveyor.

We claim:

1. In a signature gathering machine having a continuous saddle-type conveyor which revolves in an endless path including an upper, forward run terminating at at least one head end sprocket and merging into a lower, return run which terminates at at least one tail end sprocket where the return run merges into the forward run, a plurality of signature feeders for delivering signatures onto the conveyor, a stitcher having a stitcher head and reciprocating means for receiving the gathered signatures from the conveyor and advancing them to the stitcher head, an elongated, continuous mainline drive shaft, first takeoff means engaging the mainline drive shaft along its length for driving the stitcher heads and second takeoff means engaging the mainline drive shaft along its length a spaced distance from said first takeoff means for driving said reciprocating means, the improvement comprising means for reducing conveyor vibration including means for driving said tail sprocket and a flywheel mounted on the mainline drive shaft between the first and second takeoff means.

2. The structure of claim 1 further including a lower rail located above the return run of the conveyor and guiding the return run throughout its length.

* * * * *